US007503578B2

(12) United States Patent
Poellmann

(10) Patent No.: US 7,503,578 B2
(45) Date of Patent: Mar. 17, 2009

(54) SLIDING BOARD IN PARTICULAR SKI OR A SNOWBOARD AND A METHOD FOR PRODUCTION THEREOF

(75) Inventor: Edgar Poellmann, Vienna (AT)

(73) Assignee: Tyrolia Technology GmbH, Schwechat (AT)

( * ) Notice: Subject to any disclaimer, the term of this patent is extended or adjusted under 35 U.S.C. 154(b) by 306 days.

(21) Appl. No.: 10/520,543

(22) PCT Filed: Jun. 25, 2003

(86) PCT No.: PCT/EP03/06660

§ 371 (c)(1),
(2), (4) Date: Jan. 5, 2005

(87) PCT Pub. No.: WO2004/007036

PCT Pub. Date: Jan. 22, 2004

(65) Prior Publication Data

US 2005/0236785 A1 Oct. 27, 2005

(30) Foreign Application Priority Data

Jul. 10, 2002 (EP) ..... 02015378

(51) Int. Cl.
*A63C 5/00* (2006.01)

(52) U.S. Cl. ..... 280/607; 280/601; 280/609; 280/610

(58) Field of Classification Search ..... 280/601–611
See application file for complete search history.

(56) References Cited

U.S. PATENT DOCUMENTS 3,352,566 A * 11/1967 Kennedy ..... 280/610
3,722,901 A * 3/1973 Koike ..... 280/610
3,814,452 A * 6/1974 Arnsteiner ..... 280/610
3,915,466 A * 10/1975 Matsuda ..... 280/617
4,871,337 A * 10/1989 Harris ..... 441/70
5,016,901 A 5/1991 Mayr
5,769,445 A * 6/1998 Morrow ..... 280/610
5,836,604 A * 11/1998 Piegay ..... 280/607
5,944,335 A * 8/1999 Riepler ..... 280/602
6,102,428 A * 8/2000 Bobrowicz ..... 280/607

(Continued)

FOREIGN PATENT DOCUMENTS

DE 2127330 A 12/1972

(Continued)

OTHER PUBLICATIONS

International Search Report dated Oct. 17, 2003 (4 pages).

*Primary Examiner*—Christopher P Ellis
*Assistant Examiner*—Katy Meyer
(74) *Attorney, Agent, or Firm*—Flynn, Thiel, Boutell & Tanis, P.C.

(57) ABSTRACT

The invention relates to a sliding board, in particular a ski or snowboard, with at least one interface element connected to the sliding board body, in particular a rail or guide element for the arrangement of binding elements on the upper side of the sliding board. A cradle or cassette (7) is integrated in the body of the sliding board, to which interface element(s) (5, 5') is(are) fixed, whereby the cradle or cassette (7) and preferably also the interface element(s) (3, 3') is(are) connected to further sliding board components with foam or preferably with a foamed core (6).

11 Claims, 2 Drawing Sheets

U.S. PATENT DOCUMENTS

| | | | | |
|---|---|---|---|---|
| 6,183,000 | B1 * | 2/2001 | Piatti | 280/610 |
| 6,612,605 | B2 * | 9/2003 | Andrus et al. | 280/610 |
| 6,641,162 | B2 * | 11/2003 | Allmann et al. | 280/607 |
| 7,011,331 | B2 * | 3/2006 | Riepler | 280/601 |
| 7,192,048 | B2 * | 3/2007 | Restani | 280/607 |
| 2002/0008365 | A1 | 1/2002 | Andreas et al. | |
| 2002/0017771 | A1 | 2/2002 | McManus et al. | |

FOREIGN PATENT DOCUMENTS

| | | | |
|---|---|---|---|
| DE | 2237164 | A | 2/1974 |
| EP | 0313866 | A | 5/1989 |
| EP | 0411478 | A | 2/1991 |
| EP | 1 161 972 | | 12/2001 |

* cited by examiner

SLIDING BOARD IN PARTICULAR SKI OR A SNOWBOARD AND A METHOD FOR PRODUCTION THEREOF

The invention relates to a sliding board, in particular a ski or a snowboard, comprising at least one interface element, in particular a rail or guide element, connected to the sliding-board body for arranging of binding elements on the upper side of the sliding board. The invention relates furthermore to a method for the manufacture of a sliding board, in particular a ski or a snowboard, where a preformed sliding-board upper part having an upper cup is connected to a sliding-board lower part having an outsole, if necessary, a lower belt and steel edges, and foam is introduced.

A sliding board of the abovementioned design is known from the EP-A-1 161 972. A rail system consisting of at least one profile rail is in this design connected through at least one attached peg or peg section via a peg connection or anchoring to the sliding-board body. The sliding board or the ski body is formed for this purpose in such a manner that at least in the binding area on the upper side there is provided a trough-like recess extending in the longitudinal direction of the sliding board. On each side of this recess a raised area extends in the longitudinal direction. The profile rails are fastened on the raised areas, whereby the respective rail is inserted into a slot in the sliding-board body, which slot is open on the upper side of the sliding board, by means of an adhesive—peg—connection using profile sections, which have a profiling improving the anchoring, and is there anchored by adhesion. The installation of the profile rail is supposed to occur already during the manufacture or during molding of the sliding board. Even if the here suggested peg fastening of the profile rail has certain advantages compared with a screw fastening—the possibility of fastening over a greater length, compact design of the rails—we are dealing with a fastening of the profile rails on an already suitably preformed sliding board. In order to lower the manufacturing expenses and in order to simplify the manufacture of the system ski or sliding board with a rail or guiding system, it would, however, be desirous to be able to connect these components with one another already during manufacture of the sliding board.

This is where the invention now comes in, the purpose of which is to be able to connect interface elements for the binding parts already during the manufacture of the sliding board to the sliding-board body or rather to be able to integrate same into its design.

The set purpose is attained on the one hand by the inventively designed sliding board characterized in claim 1 and on the other hand by the inventive method for the manufacture of a sliding board, which method is disclosed in claim 6.

A cradle or a cassette is integrated in the inventive sliding board into the sliding-board body, on which cradle or cassette the interface element(s), in particular the rail or guide element (s) is or are anchored, whereby the cradle or the cassette, preferably also the interface element(s), is or are connected to further sliding-board parts through foam, preferably through a foamed core.

The inventive method is characterized in such a manner that during the assembly of the sliding-board parts or layers at least one interface element, in particular a rail or guide element is for arranging and guiding of a binding part anchored on a cradle positioned between sliding-board parts or a cassette, foam is subsequently introduced so that the interface element(s) and or the cradle or the cassette is or are connected with one another, to the foam and the further sliding-board parts.

Thus, the invention is indeed dealing with an integration of the interface element or elements with the sliding-board body during the manufacture of the ski or of the sliding board. Thus, subsequent fastening and adhesive operations for the arrangement of rail or guide elements are eliminated. Inventively integrated rail or guide elements can therefore also withstand heavy loads.

The cradle or the cassette consists in a preferred embodiment of the invention of cross bars and/or supports, which have openings or holes. The liquid foam material can easily enter through the openings or holes during the manufacture of the ski, and the necessary connection of the hardened foam to the further sliding-board parts can occur.

A further characteristic of the invention provides that the anchoring of the rail or guide elements in the cradle or the cassette occurs through locking openings provided therein, into which openings the connecting elements of the rail or guide elements can engage like a clasp connection. This not only guarantees a good hold of the rail or guide element in the ski but also a simple, economical manufacture of the ski or sliding board.

The connecting elements of the rail or guide elements are guided through individual holes, slotted holes, slots or the like in the upper cup and, if necessary, in further layers of the sliding board. This measure also supports an inexpensive and economical manufacture of inventively designed sliding boards.

Further characteristics, advantages and details of the invention will now be described in greater detail in connection with the schematized illustrations in the drawings, which illustrate one exemplary embodiment of the invention. In the drawings.

Figure 1:
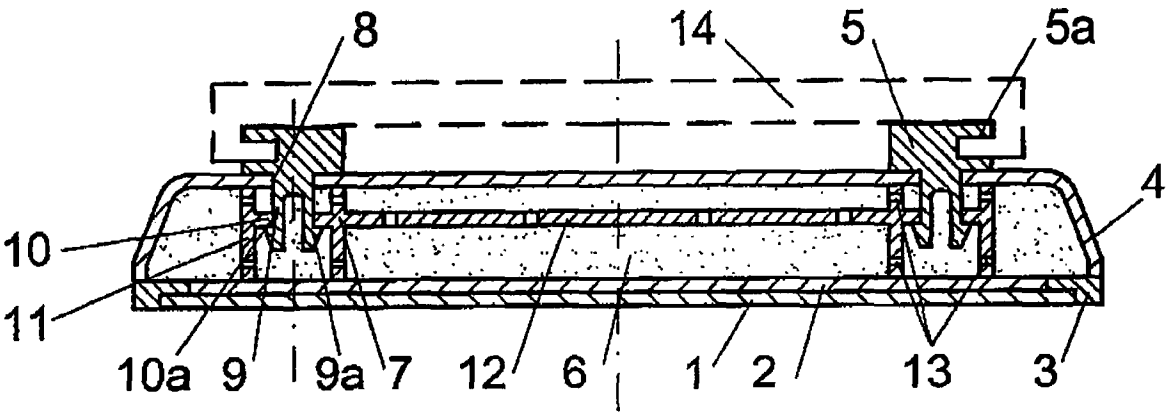
FIG. 1 is a cross section of an inventively manufactured ski.

FIG. 1 illustrates a cross section of a ski, which has an outsole 1, two steel edges 3, a lower belt 2 and an upper cup 4. The core 6 of the ski is foamed and is penetrated at least in those areas, where rail or guide elements 5 are integrated into the core 6 and the upper cup 4, by a cradle or cassette 7 or is divided into a number of core elements, which are connected with one another. At least one rail or guide element 5 extending in longitudinal direction of the ski is provided per ski binding or per ski-binding part. Two such elements 5 are integrated per ski-binding part into the ski design in the embodiment illustrated in FIG. 1. A ski-binding part, for example a front or rear binding jaw, can, for example and in a conventional manner, be moved onto the rail or guide elements 5, and can be arranged, in particular locked or fastened, in an also conventional manner. The ski-binding part or the ski binding are not the subject matter of this invention, and are therefore not discussed and also not illustrated. FIG. 1 merely indicates with a dashed line a base plate 14, which is moved onto the two elements 5. FIG. 1 shows that the rail or guide elements can for this purpose have guiding shoulders 5*a* on their edges, which extend on the outside and in longitudinal direction of the ski. Corresponding laterally bent edge areas of the base plate 14 illustrated by dashed lines overlap said guiding shoulders 5*a* when moved thereon.

The steel edges 3, the outsole 1, the upper cup 4 and the lower belt 2 can be parts basically designed in a conventional manner. For example, it is possible for the upper cup 4, which is illustrated only in one layer, to be designed also in two or multiple layers. Preferred is a design, where the upper cup 4 is already preformed in a cup shape prior to the core 6 being foamed. Further layers can be introduced below the upper cup 4.

Figure 2:
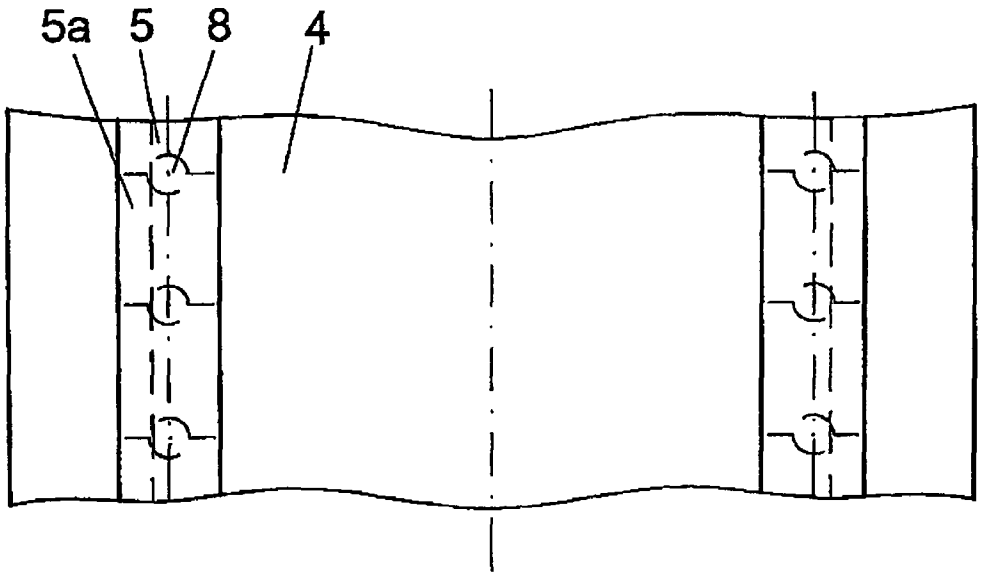
FIG. 2 is a top view of the ski of FIG. 1.

FIG. 1 in connection with FIG. 2 shows that the upper cup 4 for connecting of the rail or guide element 5 to the already mentioned cradle or cassette 7 and for binding of the same into the core 6 is provided with a number of, for example circular, connecting holes 8. The holes 8 are arranged in the forms of a row of holes extending in longitudinal direction of the ski. In the place of a row of holes it is also possible to provide one single slotted hole or several slotted holes, which also extend in longitudinal direction of the ski. Connecting extensions 9 are arranged corresponding to the positions of the holes 8 on the underside of each rail or guide element 5. The free end area 9*a* of each connecting extension 9 is centrally slotted and has undercuts, which can engage locking openings 10*a* in a longitudinal bar 10 of the cradle or cassette 7. The end areas 9*a* of the connecting extensions 9 guarantee, due to their slotted design, an easy insertion of the extensions 9 into the locking openings 10*a*. The engaging of the connecting extensions 9 at the locking openings 10*a* demands thus an elastic moldability either of the connecting extensions 9 or of the cradle or cassette 7, which can be moldable such that the locking openings 10*a* can widen to the necessary degree.

The cradle or cassette 7 is only schematically illustrated in FIG. 1 and consists here of several supporting bars 11 extending between the upper cup 4 and the lower belt 2, several longitudinal bars 10 and at least one or several connecting bar(s) 12, which create a connection to the supporting bars 11 for the second rail or guide element 5. All bars or walls of the cradle or cassette 7 have a number of openings or holes 13 in order to, as will be described hereinafter, guarantee during the foaming and forming of the core 6 a passage of the foam material and a solid connection of the core 6 to the cradle or the cassette 7, the rail or guide element 5 and the other ski parts.

Figure 3:
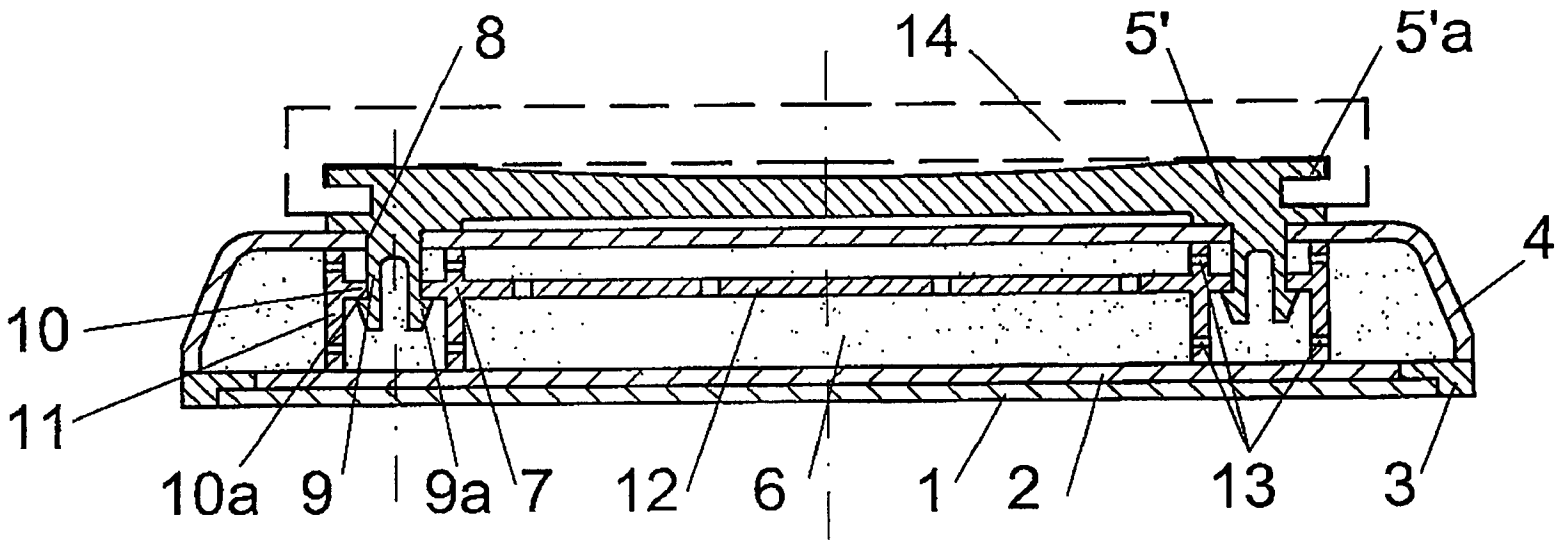
FIG. 3 is a cross-section of a further embodiment of an inventive ski.

The embodiment illustrated in FIG. 3 provides a one-piece guide element 5' for a ski-binding part or the like. The guide element 5' has for this purpose two lateral guiding shoulders 5'. The design of the guide element or of the guide elements 5, 5' or of the guiding shoulders 5*a*, 5*a*' can differ and is in particular adapted to the respective ski-binding part.

An inventively designed ski with integrated rail or guide elements 5 can be manufactured in such a manner that initially the single-layer or multi-layer designed upper cup 4, which in particular has already a decor layer, is manufactured as a cup and forms the upper part of the ski, which is connected in a conventional manner to the lower part of the ski consisting of steel edges 3, lower belt 2 and outsole 1. The cradle or cassette 7 is thereby first positioned into the cup of the upper part of the ski and is connected to the rail or guide elements 5 by insertion and connection of the connecting extensions 9. The cradle or cassette 7 serves during the manufacture of the ski as a spacer between the upper part and the lower part of the ski and as a supporting cradle. The core 6 of the ski is formed during the subsequent introduction of the foam, whereby the polymer material of the foam is at the same time the connecting means for the individual layers or elements among one another.

The cradle or cassette 7 can advantageously not only be an auxiliary construction for fixation of the rail or guide elements 5 but can also take over, as a so-called torsion box, the task of influencing and improving the stiffness of the ski. The material and/or the structural design of the cradle or cassette 7 can thereby effect a calculated influence of the stiffness behaviour of the ski. The design of the cradle or cassette 7 can thereby vary both in longitudinal direction of the ski and also in transverse direction of the ski in order to meet the desired varying bending behaviours of the ski over its length.

The invention has been described in connection with one exemplary embodiment relating to a ski. Of course, it is possible to inventively design or manufacture other types of sliding boards, for example snowboards.

Be it furthermore mentioned that at least the cradle or cassette is bound in through the foam. The rail or guide elements are preferably also held through the foam material.

The invention claimed is:

1. A method for the manufacture of a sliding board where a preformed sliding-board upper part having an upper cup is connected to a sliding-board lower part having an outsole, a lower belt and steel edges, and foam is introduced, wherein during the assembly of the sliding-board upper and lower parts at least one interface element for arranging and guiding of a binding part is anchored on a cradle or cassette fully encased within a cavity formed by said sliding-board upper and lower parts, the cradle or cassette including supporting bars extending vertically between said upper and lower parts, longitudinal bars extending in a longitudinal direction of the sliding board, and connecting bars extending in a transverse direction of the sliding board joining the supporting bars, foam is subsequently introduced so that the interface element and the cradle or cassette are connected with one another, and the cradle or cassette is completely embedded in said foam within said cavity.

2. The method according to claim 1, wherein the introduced foam forms the core of the sliding board.

3. The method according to claim 1, wherein the foam is distributed through openings provided in the cradle or cassette within the sliding-board body.

4. A sliding board comprising:

a sliding-board body, at least one interface element connected to the sliding-board body for arranging of binding elements on an upper side of the sliding board, and a cradle or cassette integrated into the sliding-board body, on which cradle or cassette the interface element is anchored, the cradle or cassette including supporting bars extending vertically between an upper cup and a lower belt, longitudinal bars extending in a longitudinal direction of the sliding board, and connecting bars extending in a transverse direction of the sliding board joining the supporting bars, wherein the cradle or cassette and the interface element are embedded within a foamed core of the sliding board, and wherein the interface element includes at least one guide element extending in the longitudinal direction of the gliding board and configured for receiving a binding or a binding part, the at least one guide element having connecting extensions connected with or inserted into the cradle or cassette such that the cradle or cassette and the connecting extensions are fixedly joined together.

5. The sliding board according to claim 4, wherein the cradle or cassette is completely embedded in an interior of the sliding board formed by the upper cup and the lower belt.

6. The sliding board according to claim 4, wherein said supporting bars bear on inner surfaces of the upper cup and the lower belt.

7. The sliding board according to claim 4, wherein the foamed core occupies the connecting extensions to prevent removal of the connecting extensions from locking openings of the cradle or cassette.

8. The sliding board according to claim 4, wherein the cradle or cassette has a number of locking openings in which connecting elements of the at least one interface element are anchored.

9. The sliding board according to claim 8, wherein the connecting elements are connected to the cradle or cassette via a clasp connection.

10. The sliding board according to claim 8, wherein the connecting extensions of the at least one interface element penetrate through holes constructed in the sliding-board upper cup.

11. A sliding board comprising:

a sliding-board body;

an interface element connected to the sliding-board body for arranging of binding elements on an upper side of the sliding board; and a cradle or cassette integrated into the sliding-board body, on which cradle or cassette the interface element is anchored, the cradle or cassette including supporting bars extending vertically between an upper cup and a lower belt, longitudinal bars extending in a longitudinal direction of the sliding board, and connecting bars extending in a transverse direction of the sliding board joining the supporting bars, wherein the interface element includes a pair of rail-like guide elements extending in the longitudinal direction of the sliding board and configured for receiving a binding or a binding part, the guide elements include connecting extensions on an underside thereof, and the connecting extensions are anchored in locking openings in the longitudinal bars by being embedded within the foamed core.

* * * * *